US005513575A

United States Patent [19]

Slade

[11] Patent Number: 5,513,575

[45] Date of Patent: May 7, 1996

[54] CORNER SUPPORT APPARATUS

[76] Inventor: Brian P. Slade, 109 Noakes Meadow, Ashford, Kent TN23 2RB, United Kingdom

[21] Appl. No.: 182,015

[22] Filed: Jan. 24, 1994

[30] Foreign Application Priority Data

Jul. 29, 1991 [GB] United Kingdom ..... 9116363

[51] Int. Cl.[6] ..... A47B 37/00

[52] U.S. Cl. ..... 108/42; 211/90; 248/239

[58] Field of Search ..... 312/238, 245; 211/90; 108/153, 152, 42; 248/224.4, 224.1, 39

[56] References Cited

U.S. PATENT DOCUMENTS 2,465,635 3/1949 Conterio .

FOREIGN PATENT DOCUMENTS 2608398 6/1988 France .
2078099 6/1980 United Kingdom .

*Primary Examiner*—Peter M. Cuomo
*Assistant Examiner*—Gerald A. Anderson
*Attorney, Agent, or Firm*—Iandiorio & Teska

[57] ABSTRACT

Support apparatus which is for fixing to first and second walls (4,6) in a corner (8) in order to form a corner shelf. The support apparatus comprises a first support member (10) having a pair of spikes (12) which are for being driven into the first wall (4), a second support member (14) having a pair of spikes (16) which are for being driven into the second wall (6), and a corner member (18) which forms the shelf and which has a first slot (20) for receiving the first support member (10) and a second slot (22) for receiving the second support member (14) such that the corner mender (18) is held in position by the first and the second support members (10,14). The first and the second slots (20,22) are such that they increase in size in a direction which extends away from the corner (8) after installation of the support apparatus and the first and the second support members (10,14) are such that they extend into the first and the second slots (20,22) by an amount which increases in the direction which extends away from the corner (8) after installation of the support apparatus.

7 Claims, 9 Drawing Sheets

CORNER SUPPORT APPARATUS

FIELD OF THE INVENTION

This invention relates to support apparatus and, more especially, this invention relates to support apparatus for fixing to first and second walls, in a corner formed between the first and the second walls.

DESCRIPTION OF THE PRIOR ART

Support apparatus such for example as a corner shelf could often be used in a room to make a corner of the room more useful and/or attractive. Often, a series of the shelves could be installed. The shelves could then be used to receive ornaments, plants, books or whatever may be desired. Shelves are not easy to fix in corners of rooms and most do-it-yourself enthusiasts are put off by the amount of labour and time involved and the ensuing mess. Plaster and masonary dust tend to go everywhere when drilling holes in walls, and support rails are usually required which tend to detract from the general neatness of the installed shelf or shelves.

In addition to the above mentioned problems of installing a shelf or shelves in corners, a further problem arises in that it can be difficult to accurately locate the or each shelf. This is mainly because it is difficult work in corners and often tools such for example as electric drills end hammers cannot be adequately used.

When installed, the or each shelf is in the nature of a relatively permanent installation which is then difficult to remove. Removal of the shelf or shelves may result in wall damage and invariably results in further mess in the form of broken plaster and masonary.

Corners of rooms might also be improved by locating in the corners support apparatus in the form of cupboards. Cupboards in the corners of kitchens can be useful, as can cupboards in the corners of lounges, offices and other rooms. The above mentioned problems encountered with installing corner shelving are also encountered in installing corner cupboards.

It is an aim of the present invention to reduce the above mentioned problems.

SUMMARY OF THE INVENTION

Accordingly, in one non-limiting embodiment of the invention there is provided support apparatus for fixing to first and second walls in a corner formed between the first and the second walls, which support apparatus comprises a first support member having at least a pair of spikes which are for being driven into the first wall, a second support member having at least a pair of spikes which are for being driven into the second wall, and a corner member having a first slot for receiving the first support member and a second slot for receiving the second support member such that the corner member is held in position by the first and the second support members.

The support apparatus can be fixed in position and removed in a very simple and very quick manner. In addition, the support apparatus does not require the drilling of walls and the subsequent use of plugs. Mess such for example as masonary dust is avoided and a hammer which is normally required for hammering the spikes into the walls can be used relatively freely and without fear of striking the walls as often occurs when installing known shelving in corners of rooms. Furthermore, the support apparatus can be fixed in position with a high degree of accuracy. Thus the support apparatus forms a clean and simple installation which is aesthetically pleasing to the eye. In addition, the support apparatus is strong and secure in use.

The support apparatus is preferably in the form of a corner shelf. However, the support apparatus may be in the form of a corner bracket for supporting corner cupboards as mentioned above.

Preferably, the support apparatus is one in which the first slot is in a first edge of the corner member, and in which the second slot is in a second edge of the corner member, the first edge being such as to lie adjacent the first wall during use of the support apparatus, and the second edge being such as to lie adjacent the second wall during use of the support apparatus. With such an arrangement, the first and the second support members are substantially invisible so that the entire support apparatus is then especially neat to look at.

If desired, the first and the second slots can be formed other than actually inside the corner member, but then the first and the second support members will be visible and so that the entire support apparatus may then not be as neat and as aesthetically pleasing as when the first and the second slots are in the first and the second edges of the corner member.

Usually, the first and the second support members will only have one pair of the spikes. If desired however three or more of the spikes may be used in each of the first and the second support members.

Preferably, the first and the second support members each have a flat edge from which the pair of spikes project, and a curved body part extending away from the flat edge.

Preferably, the spikes are fixed in position in the first and the second support members. If the first and the second support members are made of a mouldable material, for example a plastics material, then the first and the second support members may be moulded around the spikes. Alternatively, the first and the second support members may be produced to shape and then blind holes can be formed for receiving the spikes.

Usually, the spikes will be metal spikes since the spikes must be sufficiently robust to enable them to be hammered into the first and the second walls.

Preferably, the corner member is generally quadrant shaped. Other shapes may be employed for the corner member if desired.

The shelf may include a locating member for locating the first and the second support members in position on the first and the second walls. The locating member may be a flexible locating member having first and second arms which are at right angles to each other and which have therebetween a web for extending into a third slot in the corner member.

The corner member is preferably made of a plastics material, wood or a metal. The corner member may be made from the same or different materials as those used for the first and the second support members.

BRIEF DESCRIPTION OF THE DRAWINGS

Embodiments of the invention will now be described solely by way of example and with reference to the accompanying drawings in which.

DESCRIPTION OF THE PREFERRED EMBODIMENTS

Figure 1:
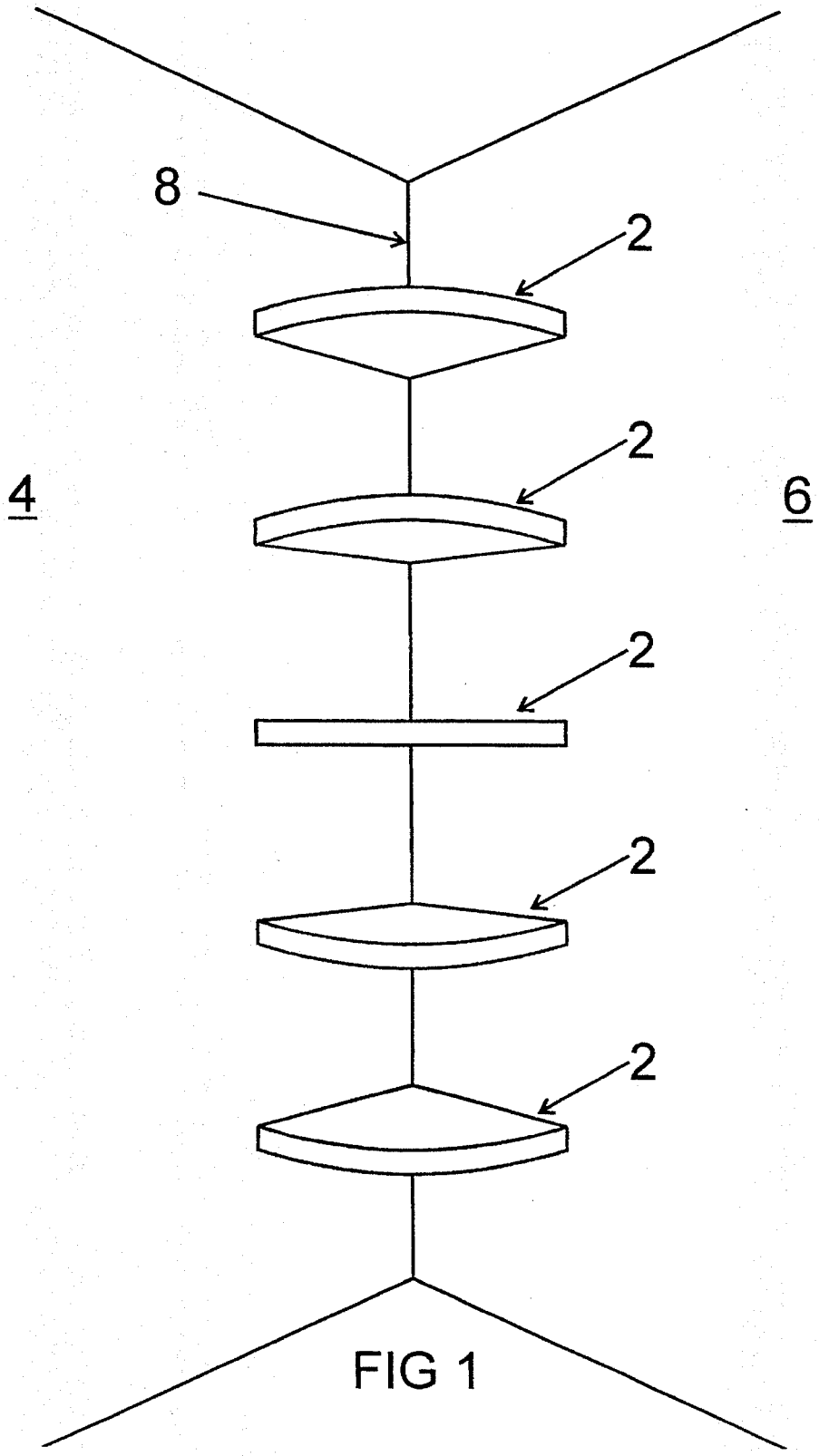
FIG. 1 shows support apparatus in the form of a series of shelves installed in the corner of a room.

Referring to FIG. 1, there is shown support apparatus in the form of five shelves 2. Each shelf 2 is fixed to a first wall 4 and a second wall 6 in a corner 8 formed between the first and the second walls 4, 6.

Figure 2:
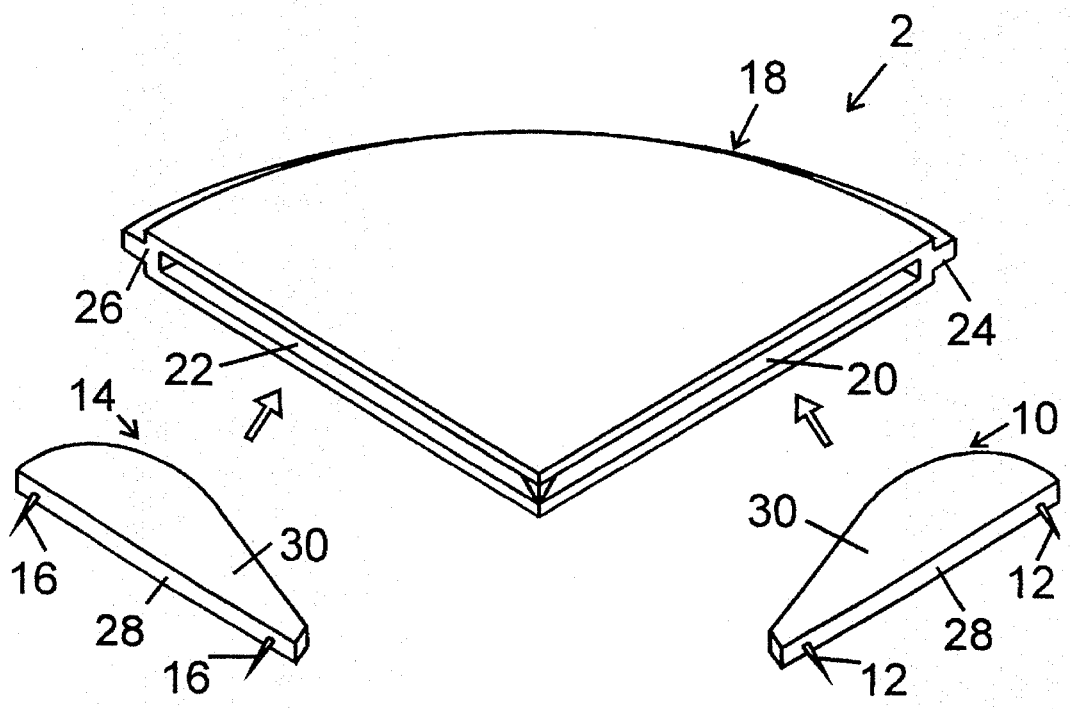
FIG. 2 is an exploded view of one shelf.
Figure 3:
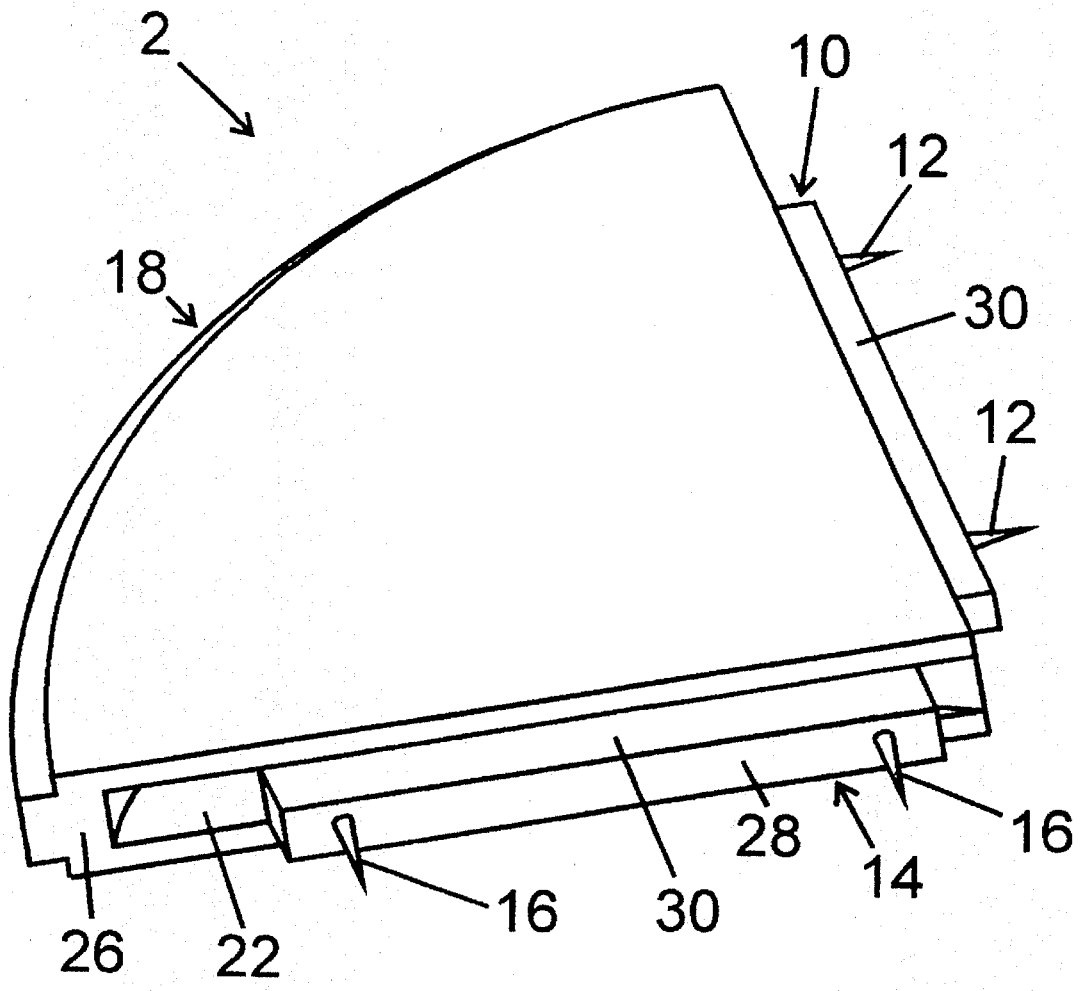
FIG. 3 shows the shelf of FIG. 2 in a partially assembled form.

As shown most clearly in FIGS. 2 and 3, each shelf 2 comprises a first support member 10 having a pair of spikes 12 which are for being driven into the first wall 4. The shelf 2 also comprises a second support member 14, which has a pair of spikes 16 which are for being driven into the second wall 6. The shelf 2 further comprises a corner member 18 having a first slot 20 for receiving the first support member 10, and a second slot 22 for receiving the second support member 14. The first and the second slots 20, 22 receive the first and the second support members 10, 14 such that the corner member 18 is held in position by the first and the second support members 10, 12.

The first slot 20 is in a first edge 24 of the corner member 18, and the second slot 22 is in a second edge 26 of the corner member 18. The first edge 24 is such as to lie adjacent the first wall 4 during use of the shelf 2. The second edge 26 is such as to lie adjacent the second wall 6 during use of the shelf 2. When the first and the second support members 10, 14 are in the first and the second slots 20, 22, and when the first and the second edges 24, 26 are abutting the first and the second walls 4, 6, then the first and the second support members 10, 14 will be invisible and the shelf 2 will just appear to be formed by the corner member 18.

As can be seen from FIG. 2, the first and the second support members 10, 14 each have a flat edge 28 from which the spikes 12, 16 project, and a curved body part 30 which extends away from the flat edge 28. The shape of the curved body part 30 is shown most clearly in FIG. 2.

The spikes 12, 16 will usually be metal spikes over which the curved body parts 30 are moulded. The curved body parts 30 can then be hammered to drive the spikes 12, 16 into the first and the second walls 4, 6 without fear of the spikes 12, 16 breaking out through the curved body part 30.

The corner member 18 is quadrant shaped as shown. The corner member 18 may be made from a plastics material, wood or metal as may be desired.

Each shelf 2 is strongly fixed in position. The spikes 12, 14 are subjected mainly to a shear force, to which the spikes 12, 16 have a high resistance. The first and the second walls 4, 6, will usually be cement rendered walls having a skim plaster finish, such walls being typical in most houses, offices, showrooms, shops, factories and the like. The cement rendering is subject to a mainly compressive force, to which the cement rendering has a high resistance.

The spikes 12, 16 may be of any suitable and appropriate length depending upon the thickness of the cement rendering, which is usually between 14 mm and 22 mm.

The shelves 2 may be fixed to other wall surface materials providing that such wall surface materials normally provide a good fixing for nails. Thus other wall surface materials include wood and similar fibrous materials. Ceramic tiled surfaces will usually not be suitable since they will tend to crack and plasterboard surfaces will also usually not be suitable because they tend to have a low mechanical strength.

The various components of the shelf 2 can be made in different materials and/or in different colours and/or in different finishes.

Figure 4:
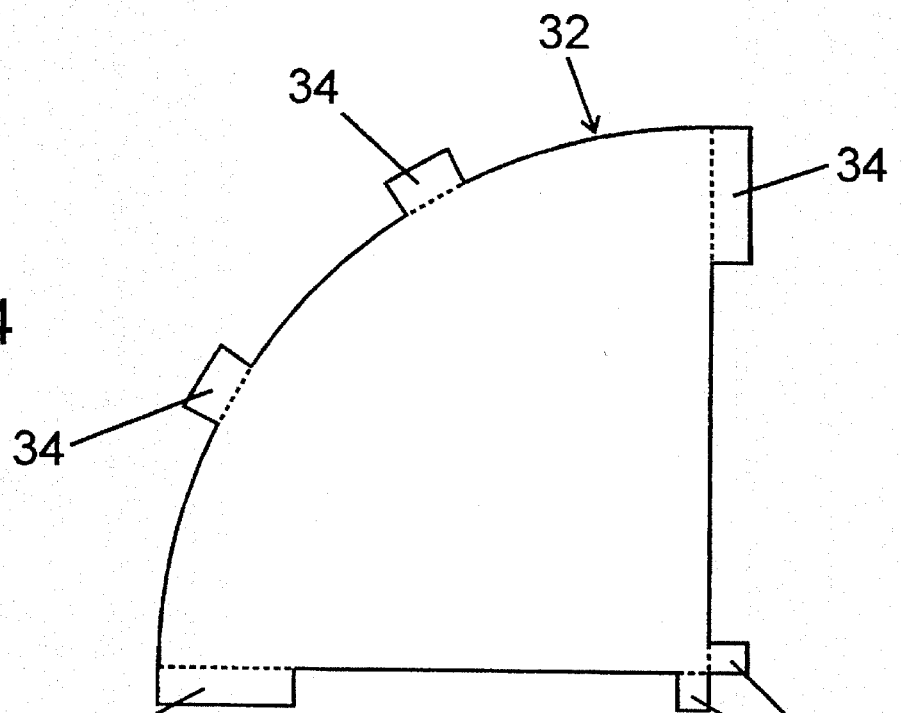
FIGS. 4 to 9 illustrate how the shelf shown in FIGS. 2 and 3 can be installed.
Figure 5:
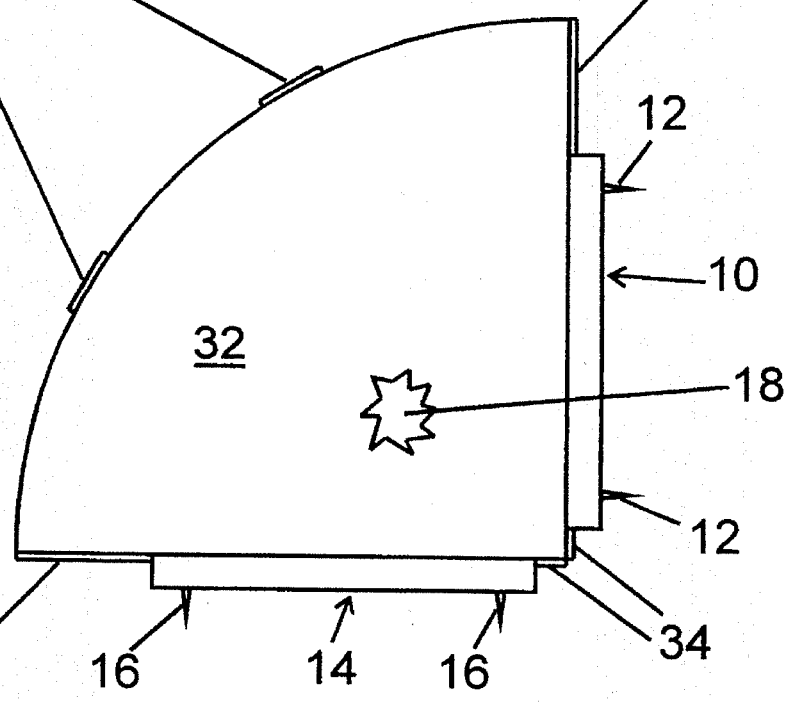

Referring now to FIGS. 4 and 5, there is shown a thin sheet of card 32 which has the same shape and dimensions as the corner member 18 and which is additionally provided with flaps 34. The flaps 34 are bent at an angle of 90° to the plane of the surface of the card 32. The card 32 is then fitted to the corner member 18. The first and The second support members 10, 14 can then be inserted into the first and the second slots 20, 22 respectively. The flaps 34 locate the first and the second members 10, 14 in their correct positions in the first and the second slots 20, 22, prior to fitting the corner member 18 in the corner 8. The card 32 is only used initially to enable the spikes 12, 16 to penetrate the surface of the walls 4, 6 in the correct positions. The card 32 is removed before The corner member 18 is moved to its final position. The card 32 is also useful in protecting the surface of the corner member 18 prior to use of the shelf 2.

Figure 6:
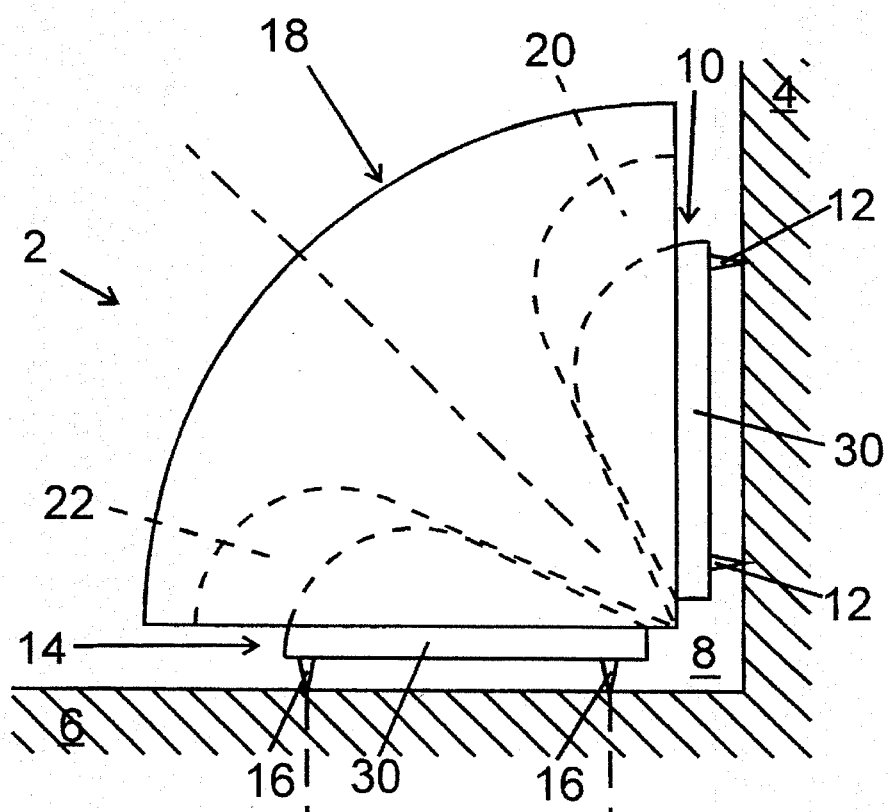
Figure 7:
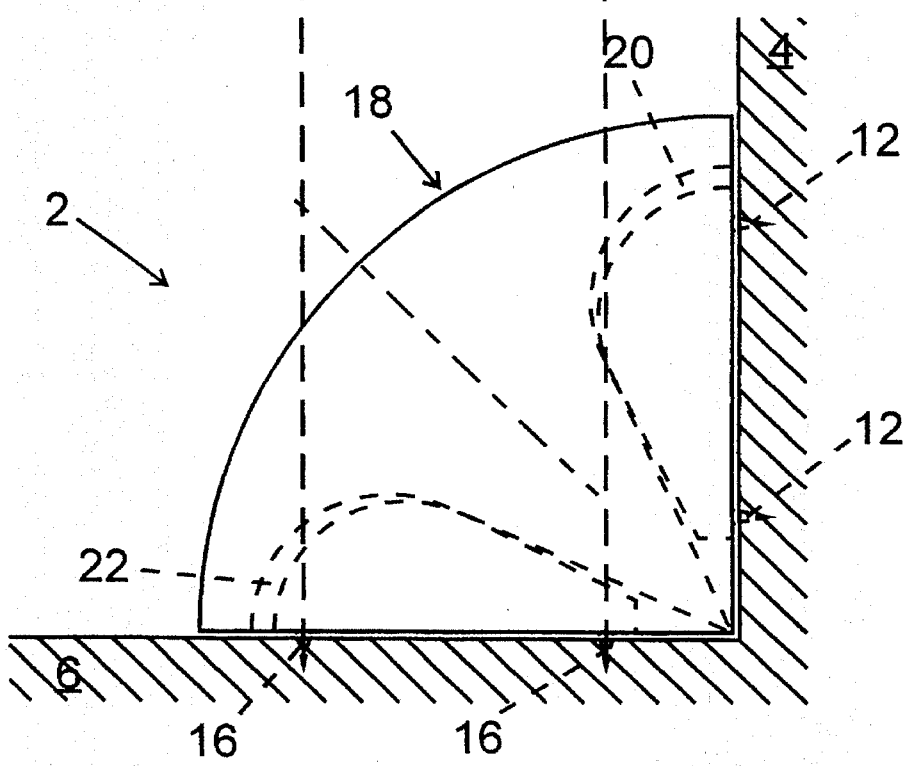

FIGS. 6 and 7 illustrate how the corner member 18 slides into position over the first and the second support members 10, 14 and into the corner 8. The dotted lines in FIGS. 6 and 7 show how the corner member 18 moves into position such that it slides along the line A-A towards the corner 8. It can also be seen that the spikes 12, 16 get driven into the walls 4, 6 respectively, whilst the first and second support members 10, 14 slide into their slots 20, 22 and eventually occupy substantially The entire space within the slots 20, 22.

Figure 8:
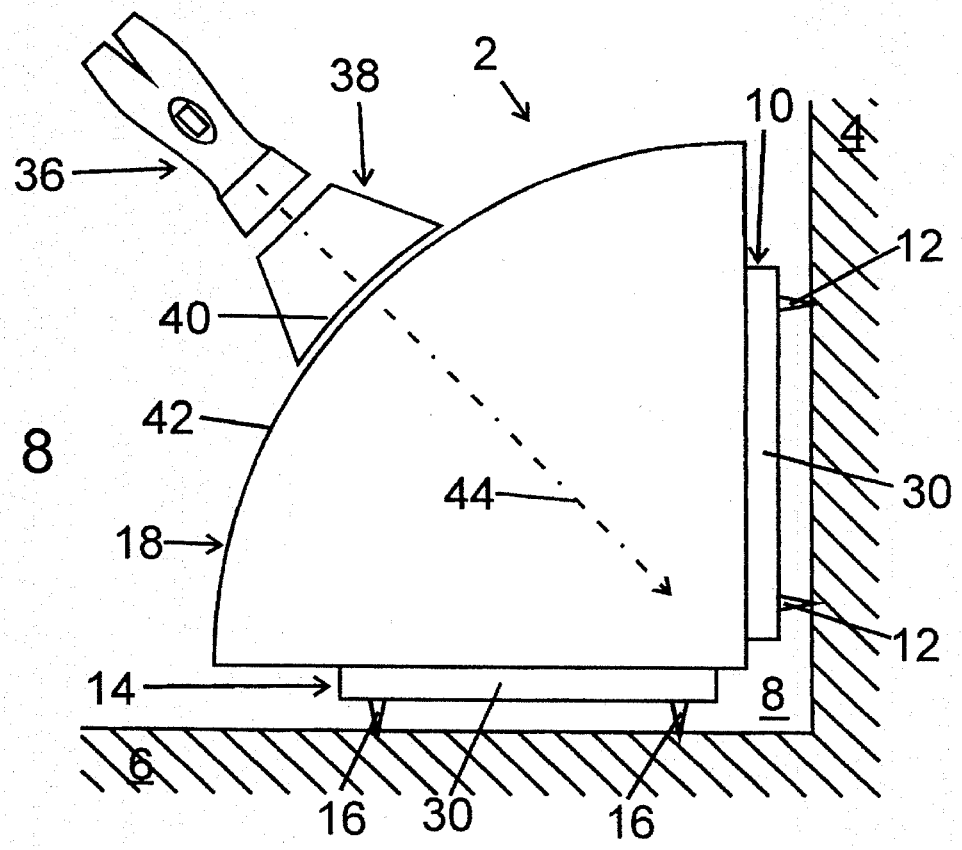
Figure 9:
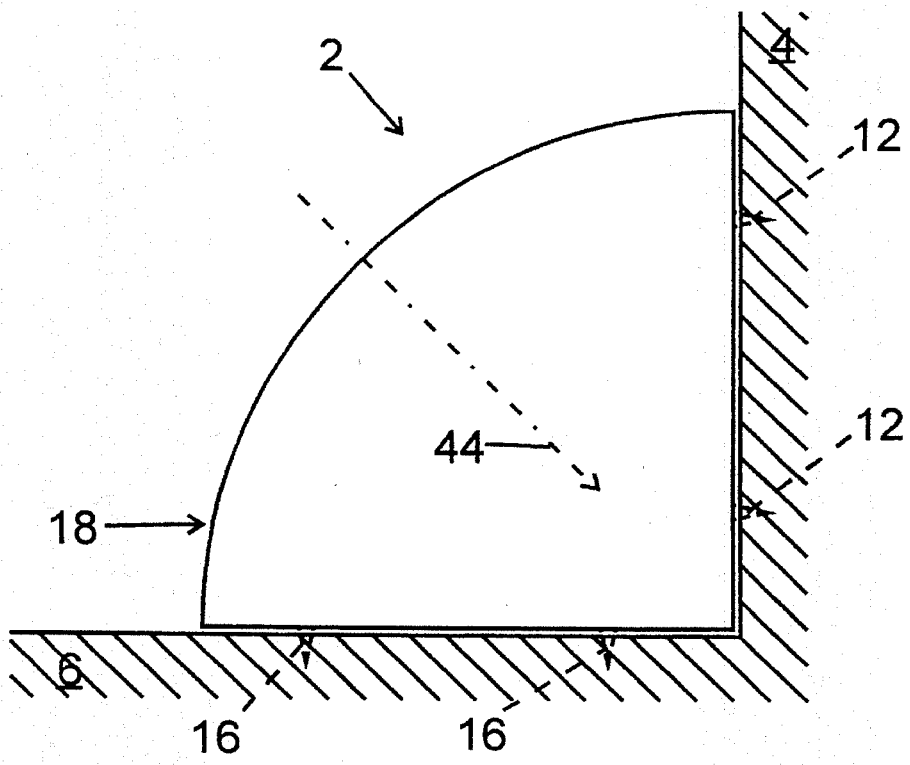

FIGS. 8 and 9 illustrate how a hammer or a mallet 36 are used to strike a block 38 in order to slide the corner member 18 over the first and the second support members 10 and into the corner 8. It will be noticed that the block 38 has a curved surface 40 which is the same as the curved surface 42 of the corner member 18. The corner member 18 moves in the direction of the arrow 44, that is directly in line with blows from the hammer or mallet 36.

Prior to fitting of the first and the second support members 10, 14 in position, appropriate horizontal lines will usually be drawn on the first and the second walls 4, 6 at the intended position of the shelf 2. If the walls 4, 6 have a slightly uneven surface, then the first and the second support members 10, 14 may tend to rock to and fro until the spikes 12, 16 sink into the walls 4, 6 respectively.

Figure 10:
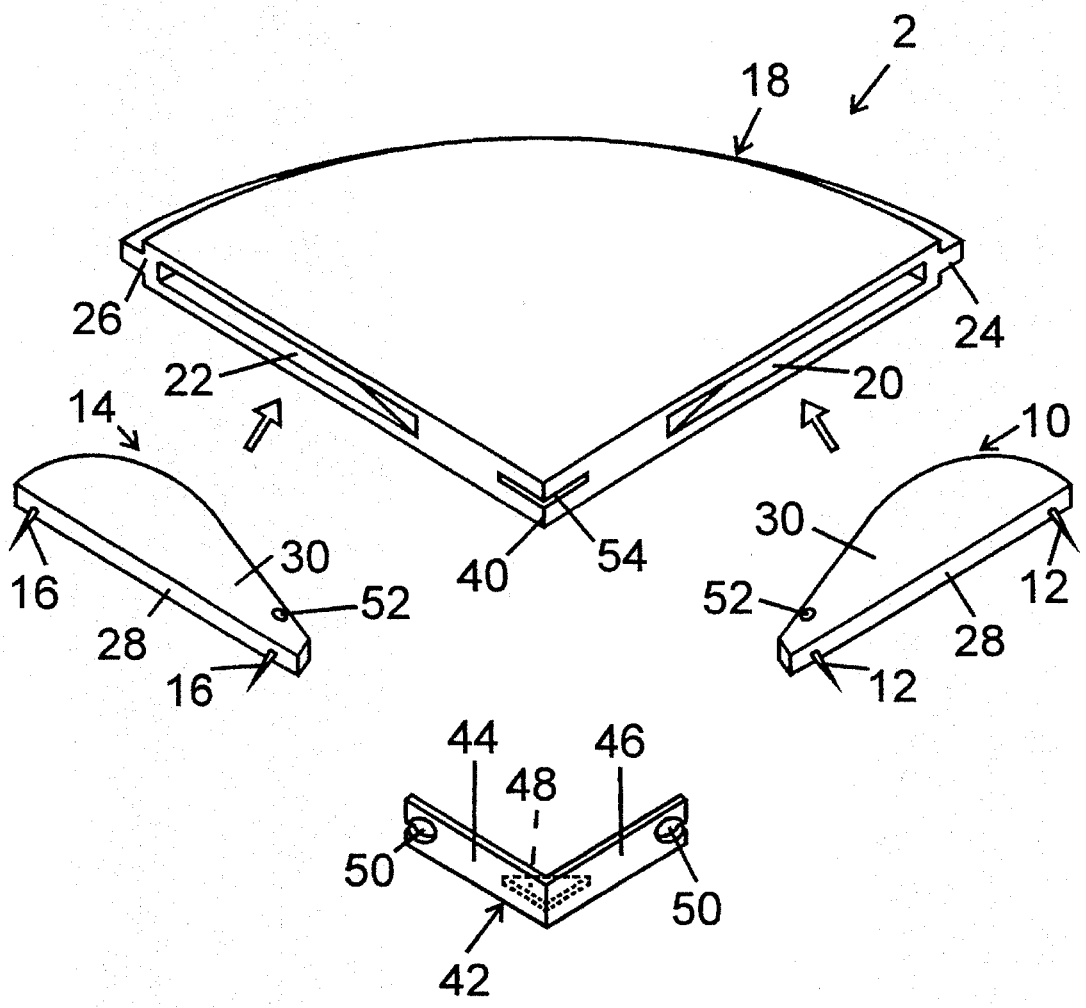
FIG. 10 is an exploded view of an alternative shelf to that shown in FIG. 2.
Figure 11:
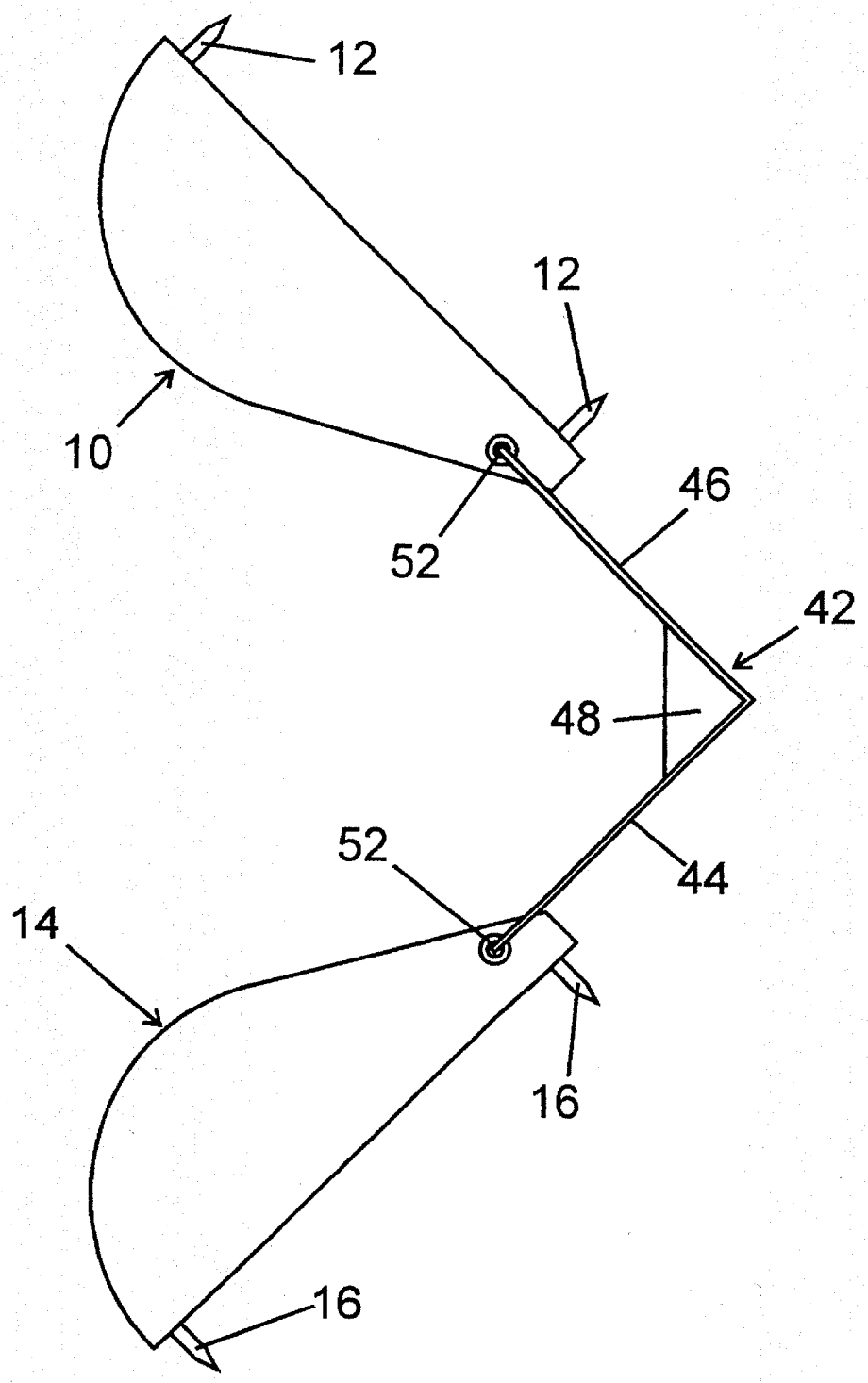
FIGS. 11 and 12 illustrate how the shelf shown in FIG. 10 can be installed.
Figure 12:
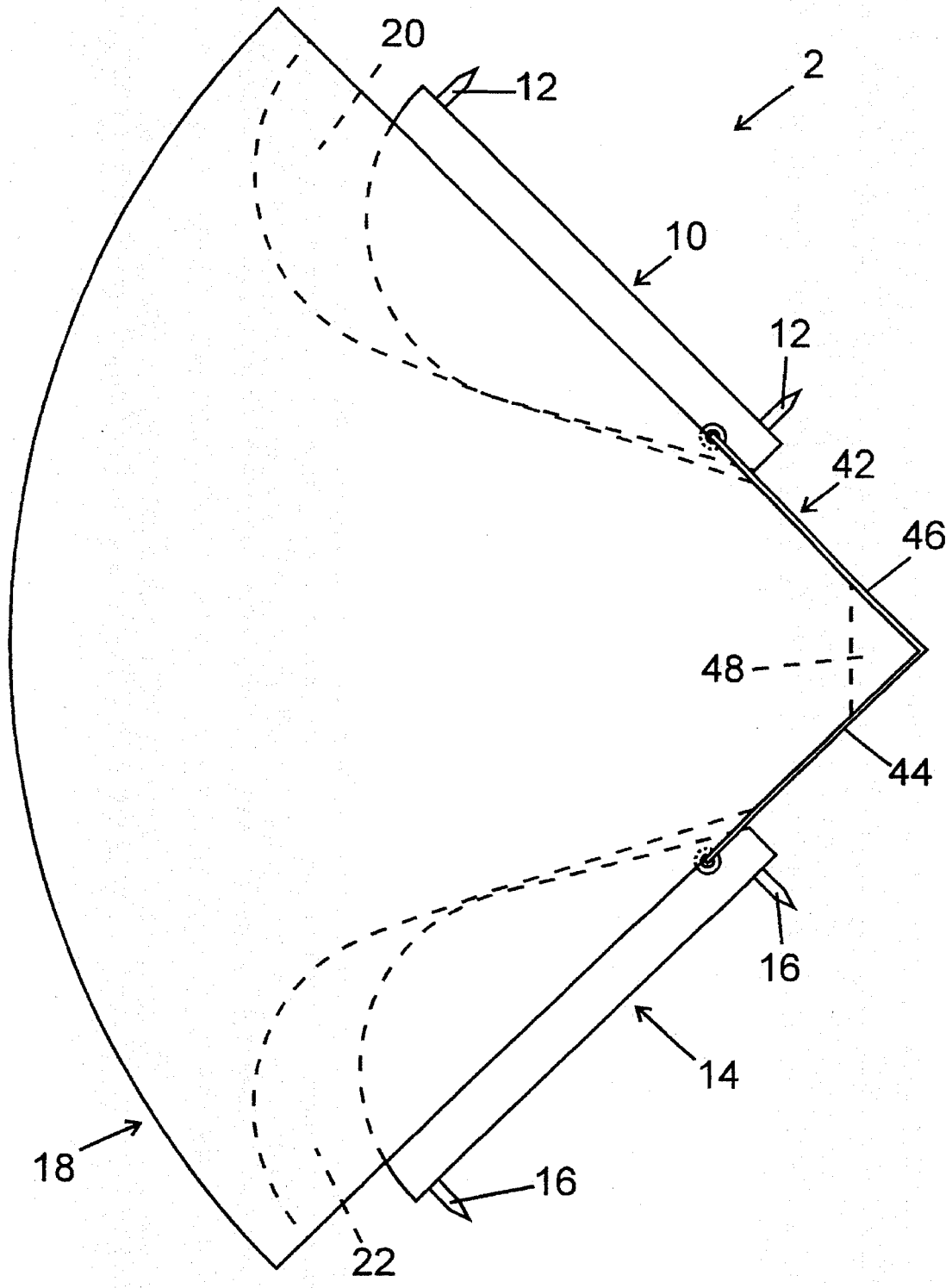

Referring now to FIGS. 10, 11 and 12, there is shown a shelf 2 which is an alternative to the shelf 2 shown in FIGS. 2 and 3. Similar parts as in previous Figures have been given the same reference numerals for ease of comparison and understanding.

The corner member 18 shown in FIG. 10 is stronger than the corner member shown in FIG. 2 in that the depth of the slots 20, 22 in FIG. 10 is not as great as the depth of the slots 20, 22 in FIG. 2. It will also be noticed that the slots 20, 22 in FIG. 10 are spaced further away from a corner portion 40 of the corner member 18 than in FIG. 2. The base of the slots 20, 22 in FIG. 10 is still formed at the same angle as the base of the slots 20, 22 in FIG. 2.

By producing the slots 20, 22 as shown in FIG. 10, the amount of machining required is reduced as compared with producing the slots 20, 22 as in FIG. 2. This in turn also enables a reduction in the dimensions of the support members 10, 14, making them more compact and cheaper to manufacture.

FIGS. 10, 11 and 12 illustrate a preferred method for retaining the support members 10, 14 in a correct starting position prior to fitting the shelf 2 into the corner 8. More specifically, the shelf 2 has a locating member 42 which is formed of a thin strip of resilient material in the shape of a right angle. The resilient material may be a plastics material. The locating member 42 thus has arms 44, 46 and a strengthening web 48 bridging the inside surface of the arms 44, 46. Each arm 44, 46 is provided with an aperture 50 as shown. The apertures 50 form the ends of the arms 44, 46 into jaws which are able to engage and locate on to small indentations 52 formed on the support members 10, 14.

During fitting of the shelf 2, the locating member 42 is able correctly to space and locate the support members 10, 14, see FIG. 11. The corner member 18 can then be pushed over the support members 10, 14 with the web 48 sliding into a third slot 54 in the corner portion 40. The slot 54 is equidistant between the top and bottom surfaces of the corner member 18. As the corner member 18 is pushed into the corner 8, the apertures 50 in the locating member 42 are able to open due to the flexible material from which the locating member 42 is made. Thus the locating member 42 is able to travel with the corner member 18 right into the corner 8. The locating member 42 thus facilitates the simple installation of the shelf 2, and the locating member 42 can be re-used as may be desired.

It is to be appreciated that the embodiments of the invention described above have been given by way of example only and that modifications may be effected. Thus, for example, the support apparatus 2 may be used to support a cupboard in a corner 8 instead of being used as a shelf. Also, the support apparatus 2 can be used on outside wall corners so that, for example, corners on the outside walls of houses or corners formed between houses and garden walls can be provided with shelves to support plant pots or other decorative items.

I claim:

1. Support apparatus for fixing to first and second walls in a corner formed between the first and the second walls, which support apparatus comprises a first support member having at least a pair of spikes which are for being driven into the first wall, a second support member having at least a pair of spikes which are for being driven into the second wall, and a corner member having a first slot for receiving the first support member and a second slot for receiving the second support member such that the corner member is held in position by the first and the second support members, the first and the second slots being such that they increase in size in a direction which extends away from the corner after installation of the support apparatus, and the first and the second support members being such that they extend into the first and the second slots by an amount which increases in the direction which extends away from the corner after installation of the support apparatus.

2. Support apparatus according to claim 1 in which the first slot is in a first edge of the corner member, and in which the second slot is in a second edge of the corner member, the first edge being such as to lie adjacent the first wall after installation of the support apparatus, and the second edge being such as to lie adjacent the second wall after installation of the support apparatus.

3. Support apparatus according to claim 2 in which the first and the second support members each have a flat edge from which the pair of spikes project, and a curved body extending away from the flat edge.

4. Support apparatus according to claim 3 in which the corner member is quadrant shaped.

5. Support apparatus according to claim 1 in which the spikes are fixed in position in the first and the second support members.

6. Support apparatus according to claim 1 in which the shelf includes a locating member for locating the first and the second support members in position on the first and the second walls.

7. Support apparatus according to claim 6 in which the locating member is a flexible locating member having first and second arms which are at right angles to each other and which have therebetween a web for extending into a third slot in the corner member.

* * * * *